United States Patent [19]

Stevens et al.

[11] 3,938,794

[45] Feb. 17, 1976

[54] CAGED SPRING UNIT

[75] Inventors: Harry G. Stevens, Union; Allan E. Randolph, Sr., Dayton, both of Ohio

[73] Assignee: Dayton Progress Corporation, Dayton, Ohio

[22] Filed: Aug. 21, 1974

[21] Appl. No.: 499,269

Related U.S. Application Data

[62] Division of Ser. No. 323,955, Jan. 15, 1973.

[52] U.S. Cl. ..... 267/130

[51] Int. Cl.[2] ..... F16F 5/00

[58] Field of Search ..... 267/130, 166, 177, 70

[56] References Cited

UNITED STATES PATENTS 2,540,525 2/1951 Howarth et al. ..... 267/177

2,815,200 12/1957 Gerhart et al. ..... 267/130

*Primary Examiner*—James B. Marbert

*Attorney, Agent, or Firm*—Jerome P. Bloom

[57] ABSTRACT

A spring unit comprising spring means, a cage for the spring means, and means to control the path of movement of the spring means within the cage having in association therewith means to apply a required pre-load on the spring means within the cage.

In preferred embodiments of the caged spring assemblies, the open spaces between the coils of a contained spring are reduced to a dimension less than that of the thickness of the coils themselves. This prevents the coils from winding or screwing and from materially affecting the prescribed pre-load in event of spring breakage.

5 Claims, 2 Drawing Figures

CAGED SPRING UNIT

Figure 1:
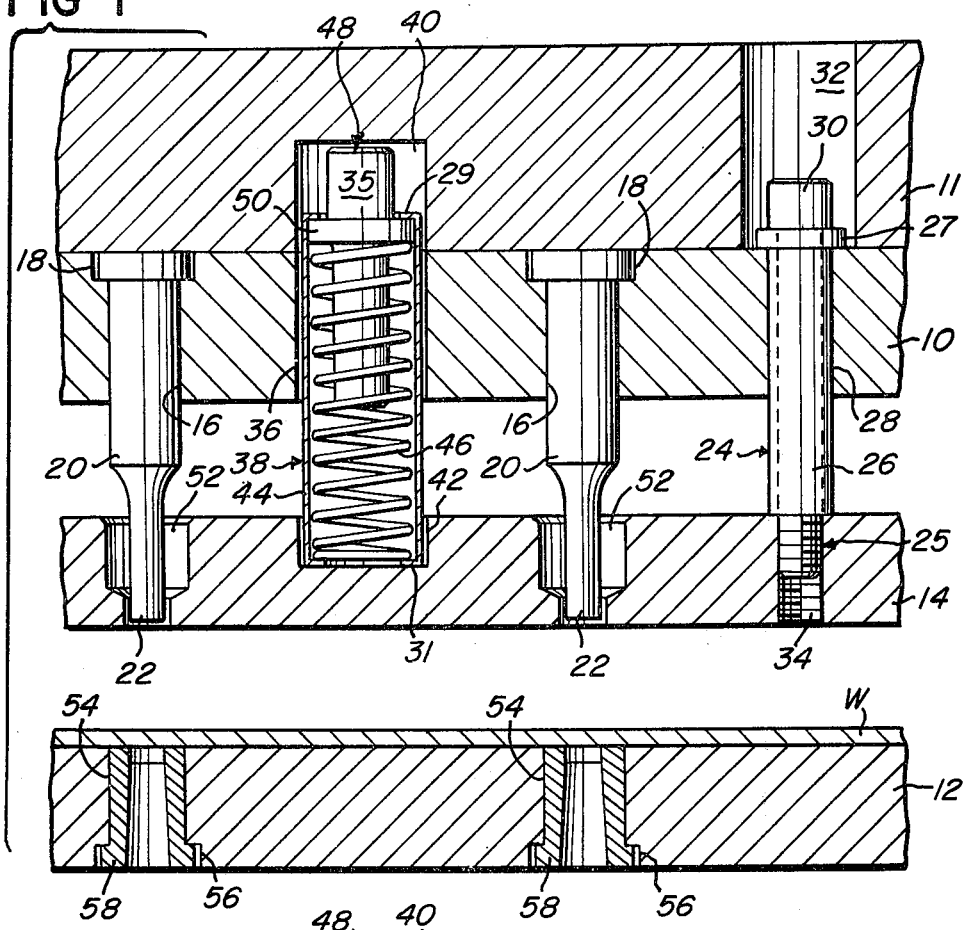

This application is a division of application for United States Letters Patent Ser. No. 323,955 filed Jan. 15, 1973 for DIE AND SPRING ASSEMBLIES HAVING PARTICULAR APPLICATION TO STRIPPER PLATES.

BACKGROUND OF THE INVENTION

This invention relates to improvements in spring units and more particularly to a caged spring unit wherein a contained spring can be simply endowed with a required pre-load which can be precisely maintained. The invention and its benefits can be most readily comprehended by a discussion of its embodiment in a stripper spring, the use thereof in application to the stripper plate of a die, and the problems solved in the process. Therefore, it will be so described by way of illustration. It should be understood, however, that neither the form of its embodiment nor the application thereof is so limited. Such is not intended.

In a die, the stripper plate is intended to serve several important functions. These functions should include a flattening of the stock to which the die tools are applied, prior to their impact. If not properly achieved, the surface of the stock presented to the tools might be wavy and cause fracture or malfunction of the die tools. A second desired function of a stripper plate is to prevent lateral movement of the stock. Failure to achieve this will obviously result in ruin of the stock. A third desired function of the stripper plate is to strip stock from the die tools, as a die is moved from its closed to its open position following a cutting, perforating, or forming operation by the tools.

In efforts to achieve the desired functions above noted, it has been the practice in the past to heavily pre-load the stripper plate through the medium of its backing or biasing springs. In conventional practice the mount and pre-load of a stripper plate is such that the stripper plate is continuously stressed, even in the open position of the die in which it is embodied. The stress so applied creates pressure points which tend, either initially or eventually, to bow or warp the stripper plate. Moreover, when the die is open this stress is transferred to the plate hangers in direct shear. This last introduces a requirement for a considerable number of hangers in the conventional mount of a stripper plate.

Further problems encountered in the mount of stripper plates as practiced in the prior art are evidenced each time the die punches or other tools must be sharpened or adjusted as to their projected length. While a shortening of the tools, the stripper plate must be adjusted. When this occurs, the problems noted above are compounded. This is self evident since the backing or biasing springs are normally further loaded, adding to the pre-load and stressing further the stripper plate and its hangers.

SUMMARY OF THE INVENTION

The present invention obviates the above noted problems as well as other problems which are inherent in prior art practice referenced to the subject matter at hand. It enables an improved die incorporating a spring biased stripper plate, the backing springs of which are pre-loaded and so applied that there is no pressure on the stripper plate in an open position of the die. Means are provided to facilitate the adjustment of the position of the stripper plate without affecting the pre-load of the stripper springs. Thus, in accordance with the invention practice the spring pre-load may be maintained constant.

The improvements noted are enabled by a particular caging of the stripper springs. An extremely important advantage of the invention is that the construction of the caged stripper spring assemblies as here provided offers safety in use to a degree not heretofore possible.

The illustrated embodiment of the invention provides a spring unit comprising spring means, a cage for the spring means, and means to control the path of movement of the spring means within the cage having in association therewith means to apply a required pre-load on the spring means within the cage.

In preferred embodiments of the caged spring assemblies, the open spaces between the coils of a contained spring are reduced to a dimension less than that of the thickness of the coils themselves. This prevents the coils from winding or screwing and from materially affecting the prescribed pre-load in event of spring breakage.

A primary object of the invention is to provide a caged spring unit wherein the spring means may be endowed with a prescribed pre-load, which spring unit is economical to fabricate, more efficient and satisfactory in use, adaptable to a wide variety of applications and unlikely to malfunction.

Another object of the invention is to provide an improved spring assembly having a particularly advantageous application as a means for biasing a stripper plate forming part of a die.

A further object of the invention is to provide improvements in springs for backing a stripper plate in a die whereby a stripper plate may be maintained under a constant load which in an open position of the die apparatus applies no pressure to the stripper plate and thereby facilitates assembly and maintenance of the die.

Another object of the invention is to provide a spring assembly possessing the advantageous structural features, the inherent meritorious characteristics and the means and mode of use herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Figure 2:
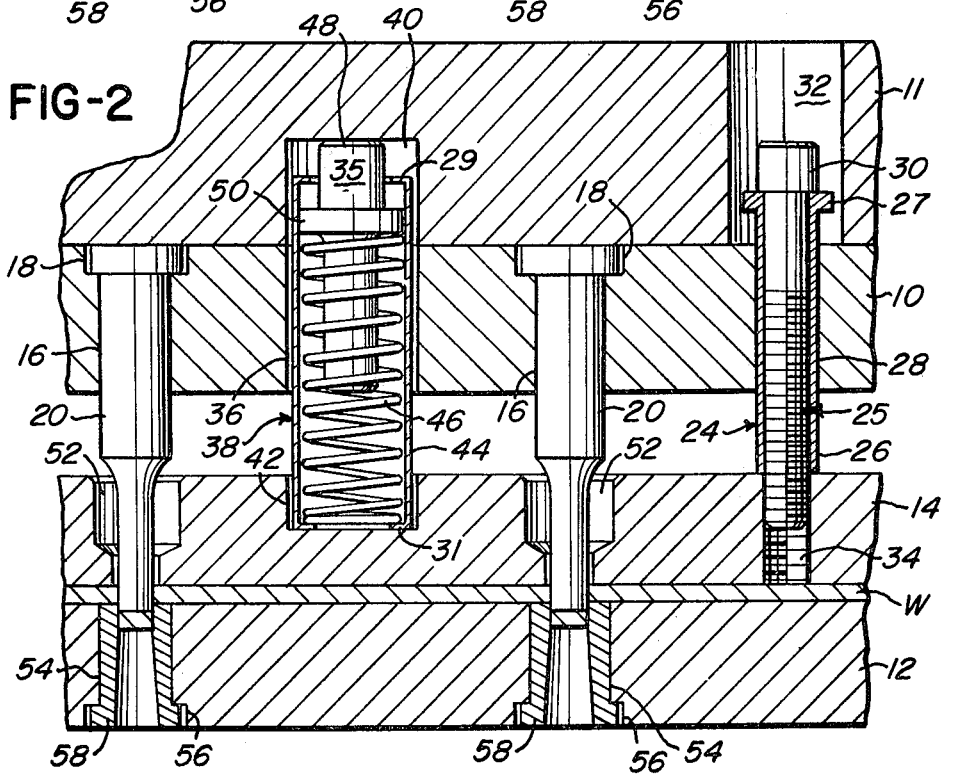

Referring to the accompanying drawings wherein is shown one but obviously not necessarily the only form of embodiment of the invention;

FIG. 1 is a fragmentary view of a die in an open position, shown party diagrammatic and in cross section, embodying caged spring units in accordance with the present invention; and FIG. 2 is a view similar to that shown in FIG. 1 but illustrating the die in a closed position.

Referring to the drawings, the portions of the die there illustrated are embodied in a suitable press to perform punching and like operations. Only so much of the structure as may be necessary for an understanding of the invention is shown.

As shown, elements of the die include a tool or punch retainer plate 10, a matrix or die retainer plate 12 and an interposing stripper plate 14. The plate 10 is backed by and releasably attached to an upper die shoe 11. The latter is suitably fixed to the ram of the press (not shown). Bolts are conventionally applied to hold the plate 10 in a fixed relation to the die shoe. The die retainer plate 12 as installed, will have a fixed mount to a lower die shoe (not shown) and forms a work surface over which a piece of stock W is positioned for performance of work thereon by suitable die tools fixed to and projected from the plate 10. The tool retainer plate 10 and its backing shoe 11, and the die retainer plate 12 and its backing shoe, may be regarded as providing, respectively, an upper or first die means and a second or lower die means.

The tool or punch retainer plate 10 has a plurality of through bores 16, the upper end of each of which is expanded adjacent the die shoe 11 by a counterbore 18. Each bore 16 accommodates the shank of a perforator or punch type tool 20 the head of which is expanded to provide thereon an external flange which seats to the annular shoulder provided by the counterbore 18. It will be noted that the surface defining the head extremity of each punch 20 will so position that it is flush with the uppermost surface of the plate 10. Each punch element 20 projects through and beyond the plate 10 and at the outer projected extremity thereof has a reduced diameter work engaging portion 22.

The plate 10 has a further plurality of through bores 28, each of which accommodates the projection therethrough of a hanger device 24. Each device 24 includes a cylindrical sleeve 26 which has a sliding fit with respect to the wall defining its bore 28. At what might be considered its upper end, each sleeve 26 projects through and beyond the bore 28 and has an external flange 27 which has an annular configuration. The flange 27 is adapted to seat to the upper surface of the plate 10, about the bore 28 in which the sleeve is inserted. The opposite end of the sleeve 26 projects, in each case, through and beyond its bore 28 to orient in a substantially parallel relation to the punch elements 20. Further comprised in each hanger device 24 is a socket head cap screw 25. The threaded shank of the screw 25 is projected through the sleeve 26 to have its lower extremity project through and beyond what might be regarded as a lower or outer end of the sleeve. The projection of the screw 25 is limited as its relatively enlarged head 30 seats on the flange 27. It is noted that the head 30 has a socket to receive an Allen type wrench.

The plate 10 is formed with a plurality of additional through bores 36, each of which accommodates a caged spring assembly 38. Each spring assembly 38 has a generally cylindrical configuration which, as installed, has a generally parallel relation to the punches 20 and the hanger devices 24. The outer housing 44 of each spring assembly has a generally cylindrical tube form and its respective vertical extremities are each turned over to define inwardly projected and radially directed flange-like abutment portions 29 and 31. With reference to the drawings, it may be seen that the upper abutment portion or flange 29 defines an opening the center of which lies in the central or vertical axis of the housing 44. Each housing 44 provides a cage for a coil spring 46 the lower extremity of which seats to the lower flange or abutment 31 while its upper extremity positions concentrically about the pin-like lower end portion of a plunger element 48. The plunger 48 has an intermediately positioned portion 50 which is enlarged in diameter to form a shoulder to either face thereof. The portion 50 has the shoulder provided at its upper surface arranged to limit against the upper abutment 29 formed on the housing 44. The lower shoulder surface of portion 50 provides a limiting surface for the upper end of the spring 46. The plunger 48 includes an extension 35 which projects beyond the portion 50 and through the opening defined by the upper abutment 29. It will be seen that by a suitable selection of the spring 46, an appropriate selection as to the length of the cage 44, and a predetermined axial dimension of the portion 50 on the plunger 48 one can provide a definite preload on the spring element 46. The criteria for obtaining the desired pre-load are obviously easy to determine.

Noting the drawings, the upper die shoe 11 is provided with apertures or recesses to form extensions of the bores 28 and 36 provided in the punch retainer plate 10 to accommodate their variously related components. For example, formed in the die shoe 11 are openings 32 positioned in correspondence with the bores 28 and forming axial extensions thereof. In each case the bore 32 is enlarged in diameter with respect to the diameter of the related bore 28 in the plate 10. This enables the bore 32 to accommodate the flange 27 on a sleeve 26 which seats to the upper surface of the plate 10 and the head 30 of the screw 25, which seats in turn to the flange 27. Further, the die shoe 11 has a series of cylindrical recesses 40 formed in the bottom thereof each of which is of like diameter and forms an axial extension with respect to a related bore 36 in the plate 10. In the case illustrated the upper end of each cage 44 and the relatively projecting extension 35 of the related plunger 48 is acccommodated in a recess 40. The length of the spring assembly 38 will preferably be such that the projected end of plunger extension 35 will have a slight clearance at its upper surface with respect to what may be considered the bottom of the recess 40 when the die is in the open position. The material of the portion 35 of the plunger 48 is such to lend itself to easy grinding whereby to make specific changes in its thickness or length, the purpose of which will be further described.

The upper die shoe 11 does not provide recesses to align with bores 16 in the plate 10. Thus, the bottom surface of the die shoe 11 provides for an abutting engagement therewith of the heads of the punches 20.

Referring now to the stripper plate 14, it will be seen that this plate has a through bore 52 aligning with each retainer plate bore 16, adapted to receive therein the reduced diameter working extremity 22 of a punch 20. At the upper extremity thereof each bore 52 is enlarged by a counterbore to accommodate the entry therein of a portion of the shank of the related punch, in the course of a working of the die. The stripper plate 14 also has an internally threaded aperture 34 arranged to align with each bore 28 formed in the plate 10. The dependent extremity of each screw 25 is threaded into an aperture 34 and the plate 14 is thereby suspended from the plate 10. Still further, the stripper plate 14 has a cylindrical recess 42 in its upper surface aligning with each bore 36 in the plate 10 to accommodate therein and seat to its base the lower extremity of a stripper spring assembly 38.

The matrix or die retainer plate 12 similarly has a plurality of through bores 54 respectively aligning with the bores 16 of the retainer plate 10 and with the through bores 52 of the intermediately disposing stripper plate 14. Pressed in each bore 54 is a tubular die button 58. The latter has an expanded head portion which seats in a counterbore 56 in the lower end of the particular bore in which it is placed.

In an assembled position of the parts, it will be seen that each punch 20 is aligned with a die buttom 58 in the die retainer plate 12 and the head thereof is abutted to and backed by the lower die shoe. (not shown).

The caged stripper spring assemblies (only one thereof being illustrated) are oriented similarly to the punches to have the lower end thereof seated in each case in a recess 42 in the stripper plate 14 and the vertically projected plunger portion thereof received in a recess 40 in the upper die shoe 11. The head extremity of the plunger portion 35 will position with slight clearance thereabove under no load conditions as in the open position of the die.

Additionally, the hanger devices 24 (only one thereof being illustrated) will in the no load position of the parts shown in FIG. 1 have the sleeve portion 26 thereof positioned so its lower end seats freely on the top of the stripper plate as it is suspended by virtue of the flange 27 at its upper extremity seating to the top of the punch retainer plate 10. The screw portion 25 of each hanger device will engage the stripper plate as described and have the head 30 thereof abutted to the flange 27 of the related sleeve.

As mentioned previously, in the first instance, in the caging of the springs 46, there is applied thereto a pre-load of a definite predetermined character, which is readily determined by the original length of the springs and their contained length as determined by the thickness or depth of the enlarged portion 50 of the plunger 48 and the dimension between the flange-like abutment portions of the cages 44. It should be noted that in each assembly the spring 46 is not only closely contained and guided by the inner wall of its cage but the pin-like body portion of the plunger 48 which depends below the portion 50 will closely guide and maintain the vertical orientation of the spring. The hanger devices 24 will be dimensioned correspondingly to the spring assemblies as indicated so that in an open position of the die there will be no additional load placed on the springs 46 and accordingly there will be no load or stress placed on the stripper plate 14 in an open position. The built-in specific pre-load in the springs 46 per se determine that the stripper plate assembly will function precisely as desired in every respect.

Considering the assembly of the die parts as illustrated in FIG. 1, it will be therefore seen that the stripper plate 14 is effectively suspended from the retainer plate 10 by hanger devices 24 with the flanged heads 27 of their sleeves 26 abutting against the upper surface of the punch retainer plate 10 to define the extent to which the stripper plate will be projected relative to plate 10. In such projected position the stripper plate will occupy a position relative to the punches 20 to house the lower dependent working extremities 22 of the punches within the bores 52, immediately adjacent and spaced from the lower surface of the stripper plate.

Thus, the compression springs 46 are fully contained and their length and pre-load basically determined by their respective cages 44. The pre-load effect on the springs will be such, of course, to urge their related plungers 48 axially outward and upward in each case with such motion being limited by the contact of the upper shoulder on portion 50 with the abutment 29 formed by the inturned upper extremity of its particular cage. The parts of each spring assembly as previously noted are so structured and related that with the spring 46 expanded to its allowable limits and with portion 50 engaging the abutment 29, the upper extremity of the plunger portion 35 is spaced from the bottom of recess 40 thereabove a distance slightly to clear the same. Thus, in the no load position of the die shown, no reactant force of a spring 46 is applied to the upper die shoe and there is no reactant force directed from the caged spring assemblies to the stripper plate 14. Attention is directed to the fact that in preferred embodiment for certain applications the spacing of the coils of each spring are made such that the axial dimension thereof is less than the thickness of the wire of which the spring is made. Thus, if during die operation a spring might break it inherently will not be able to wind or screw on itself. This insures that there will not be any material change in the pre-load.

In the operation of the die apparatus illustrated, when the ram of the press in which it is installed descends, the die shoe 11, tool retainer plate 10 and its mounted punch elements 20 descend simultaneously and vertically therewith, toward the relatively stationary die retainer plate 12 and the work piece W which is moved thereon. In the course of such movement, the lost motion inherent in the spacing between the heads of plungers 48 of the caged spring assemblies and the bases of the recesses 40 which contain them is taken up and thereafter the stripper plate spring assemblies and the stripper plate 14 itself move unitarily downward with the tool retainer plate 10, the springs 46 providing a yielding force to maintain the position required of the stripper plate by virtue of their pre-load. The relationship of the parts substantially as illustrated in FIG. 1 accordingly is substantially retained until stripper plate 14 contacts the work piece W whereupon the upper die shoe 11 and tool retainer plate 10 move relatively to the stripper plate, with the extremities 22 of punch elements 20 being caused thereby to project through and beyond bores 52 to penetrate the work piece and pass into the die buttons 58 in the lower die plate 12. In the course of this motion, as the punch extremities pierce the work W they project into the die buttons the cut slugs, which are allowed to drop free of the die buttons, through the expanding tapering bores thereof. Downward motion of the shoe 11 and tool retainer plate 10 relative to stripper plate 14 as the latter engages the work piece accomplishes a compression of the springs 46. This is produced by reason of the reactant load forcing the cages 44 vertically of the plungers 48, which at this point are abutted to the die shoe 11. Resultingly, as seen in FIG. 2, the flange portions 29 of the cages will be displaced vertically, from their no-load position in abutment with plunger portions 50. Each hanger sleeve 26 will be correspondingly displaced with its related hanger screw 25. At this time the stripper plate 14 is powerfully stressed with, however, the applied load being sustained by the plate 11 and the structure which backs the same. Due to the uniformity of the pre-load on the springs 46, there is a uniform distribution of the applied pressure. The applied pressure fixes the work piece and insures a condition of flatness thereof allowing for precise penetration of the punch elements and the formation of sharp edged openings in the work piece W.

At the bottom of a closing stroke of the press, the parts assume a position substantially as shown in FIG. 2. In a return or opening stroke of the press, retainer plate 10 and die shoe 11 are pulled away from die plate 12, retracting punch extremities 22 from the die buttons 58 and from the apertures cut in the work piece. Facilitating the latter process is the pressure applied by the springs 46 which hold the stripper plate 14 to the work while the punch elements are being withdrawn. Again the influence of springs 46 willl be balanced. Movement of the tool retainer plate 10 relatively to the stripper plate 14 continues until plate 10 abuts hanger sleeve flanges 27 whereupon continued retraction of the upper die shoe and retainer plate 10 is accompanied by a lifting of plate 14 from the work. The return motion continues until the parts reach substantially the position shown in FIG. 1, which may be described as the fully open position of the press and the die. In the interval during which the press is open or during which it is opening, the work piece W may be advanced to clear the die or bring a new section thereof to overlie the die buttons 58 in preparation for the next closing stroke of the press.

In the early part of the return stroke of the tool retainer plate 10, accomplished relatively to stripper plate 14, the spring or springs 46 are gradually relieved of their compression and at about the same time that the plate 10 abuts hanger flanges 27, upper shoulder surfaces on portions 50 of the spring plungers will limit against abutments 29. The superposed reactant pressure applied on the stripper springs in the die operation accordingly is released and as the die parts reach an open position and while they retain such position the stripper plate 14 is unstressed by the stripper springs 46, though they inherently retain their pre-load. Excessive shear force upon the hanger devices 24 is avoided, as well as warping or otherwise damaging influences being exerted upon the stripper plate. As long as the press remains in an open position, the spring or springs 46, while maintaining a pre-loaded condition, are ineffective to apply their stored energy in a stressing of the plate 14.

In use of the die, the punch elements 20 will wear and their operating portions 22 must be resharpened by grinding. This naturally has the effect of shortening the overall length of the punch elements and alters the relationship between the punch elements and the stripper plate 14 with possible loss of punching or cutting effectiveness unless the position of the stripper plate is adjusted. Thus, following a grinding down of punch elements 20, the stripper hanger devices must be adjusted to retract the stripper plate 14 in a manner to restore the original relationship between the plate and the punch elements. As will be evident, in the invention assembly a rotary motion applied to the heads 30 of screw means 25 will turn the latter in threaded bores in the stripper plate. This is necessary to bodily reposition the plate 14 but in accordance with the invention, the screws 25 cannot be turned into the stripper plate unless there is an adjustment as to the length of the sleeves 26. In accordance with the invention, the sleeves 26 will be ground off at their lower end portions an amount equal to the length of material ground from the operating ends 22 of the punches 20. This will enable a precise adjustment of the stripper plate 14 on turning the screw means 25 into the stripper plate in correspondence with the adjustment of the length of the punches 20. If only this is done, the adjustment of the position of the stripper plate 14 as to its open position relative the plate 10 can obviously cause an addition to the pre-load on the springs 46 to thereby stress the stripper plate in the open position thereof. This is avoided in accordance with the invention by the provision that the extensions 35 of the plungers 48 may be easily reduced as to their length by grinding or other suitable means in correspondence with the amount of the shortening of the punches 20 and the sleeves 26. Thus, by a corresponding and equal adjustment of the length of the punches 20, sleeves 26 and extensions 35 of the plungers 48, once more we have, in a simple fashion, provided for an unstressed condition of the stripper plate 14 in the no load or open position of the die. There is no complexity in the operation of the invention system and the adjustment thereof and one can readily insure a uniform and constant pre-load in reference to the stripper spring assemblies.

In summary, the invention stripper plate spring assemblies enable a uniform and constant loading of the contained springs in the first instance. As employed, moreover, the stripper spring assemblies, in accordance with the invention, will neither distort the stripper plate or unevenly stress the same. In addition, load in shear on the hanger devices utilized for the stripper plate is completely avoided. This enables that a stripper plate may be suspended by relatively few hanger devices, thereby reducing machining and number of parts required for a die. An ancillary advantage is the enabling of an increase in available tool area within a die. It is obvious, of course, that the involved parts will have a longer operating life. The fact that the springs 46 can in the first instance be endowed with precise design specifications and retained as to specified pre-load values throughout the operation of die apparatus is an important factor in the substantial benefits of the invention. Safety is also inherent in the spring assemblies as here provided due to both the inner and outer containment of the spring devices.

While in the spring assemblies illustrated only one spring element has been shown in each instance, it is of course obvious that plural spring elements can be utilized in tandem within a cage such as the cage 44 illustrated without departing from the basic concept of the invention. Where plural springs are employed within a cage, there obviously can be a suitable modification of the plunger or plungers employed such as 48 in a manner well evident to one versed in the art. Where plural springs are employed within a single cage, the arrangement could of course also provide for a differential rating of the simultaneously contained springs. The use of spring assemblies of this nature may be considered, for example, where one contemplates a light lead-in pressure and a heavier working pressure towards the end of a stroke of a die set.

It is also evident that spring assemblies here illustrated can be employed in a reverse or inverted position with the plunger abutting against the stripper plate without loss of effectiveness and still within the concept of the invention.

As is obvious the spring assemblies here illustrated can have a utility apart from the specific embodiment shown. The assembly will have advantage in any case where safety, constant pre-load and adjustment without changing pre-load are important and necessary assets.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

Having thus described our invention, we claim:

1. A device for use as an independent pre-loaded stripper spring unit comprising a cage containing a longitudinally extending compressible spring, means at one end of said cage providing a seat for one end of said spring, means at the other end of said cage defining an aperture therein, a plunger-like means within and oriented axially of said cage having a portion enlarged in diameter to form opposite facing, axially spaced, shoulders, an inwardly facing shoulder being engaged by an opposite end of said spring and an outwardly facing shoulder limiting against the said other end of said cage around said aperture, under the urging of said spring, an extension of said plunger-like means being projected through said aperture to extend the length of the assembly comprising said cage, said spring and said plunger, said plunger-like means being accessible through its said extension to be moved inwardly of said cage to reduce the normal length of said assembly and apply a spring load to urge an axial projection of said cage, and said plunger extension being fabricated to facilitate a reduction of its projected length and the normal length of said assembly without a requirement for applying an additional load on said spring or said cage.

2. A device according to claim 1, wherein said plunger-like means is a single element one end of which projects within and axially of said opposite end of said spring.

3. A device according to claim 1, wherein said spring is comprised of coil spring means which in the normal condition of said assembly has a spacing between adjacent coils the dimension of which is less than the thickness of the wire forming said coils.

4. A device according to claim 1, wherein said cage is a symmetrical member with its said opposite ends turned over to provide abutments respectively for said one end of said spring and for said outwardly facing shoulder, said spring being fully contained thereby in said cage in a pre-loaded condition.

5. A device according to claim 1, wherein said plunger-like means has a free floating mount in said cage and said enlarged portion thereof has a substantially sliding contact with an interior wall surface of said cage.

* * * * *